US006731207B1

(12) United States Patent
Swieboda et al.

(10) Patent No.: US 6,731,207 B1
(45) Date of Patent: May 4, 2004

(54) MODULAR DETECTOR SYSTEM

(75) Inventors: Michael A. Swieboda, Naperville, IL (US); Mark A. Devine, Shorewood, IL (US); Andrew J. Ivanecky, Aurora, IL (US); Kenneth L. Venzant, Bolingbrook, IL (US); Derek S. Johnston, Batavia, IL (US); Romualdo S. Siazon, Carpentersville, IL (US); Floyd E. Brooks, Montgomery, IL (US)

(73) Assignee: BRK Brands, Inc., Aurora, IL (US)

( * ) Notice: Subject to any disclaimer, the term of this patent is extended or adjusted under 35 U.S.C. 154(b) by 0 days.

(21) Appl. No.: 09/724,457

(22) Filed: Nov. 28, 2000

Related U.S. Application Data

(60) Provisional application No. 60/172,458, filed on Dec. 17, 1999.

(51) Int. Cl.[7] ..... G08B 23/00

(52) U.S. Cl. ..... 340/501; 340/527; 340/500; 340/286.05; 340/825.69; 340/628; 340/577

(58) Field of Search ..... 340/527, 500, 340/501, 286.05, 506, 511, 539, 825.69, 628, 632, 577, 507, 514

(56) References Cited

U.S. PATENT DOCUMENTS 3,656,139 A * 4/1972 Wintriss ..... 340/690
4,772,875 A * 9/1988 Maddox et al. ..... 340/522
5,973,591 A 10/1999 Schwartz et al.
6,114,967 A * 9/2000 Yousif ..... 340/690
6,118,386 A * 9/2000 Yousif ..... 340/690
6,323,780 B1 * 11/2001 Morris ..... 340/692
6,426,703 B1 * 7/2002 Johnston et al. ..... 340/628

OTHER PUBLICATIONS

Notification of Transmittal of The International Search Report or the Declaration mailed Jun. 14, 2001 for the PCT counterpart of the above–identified US application (7 pages).

Cover page of Written Opinion of PCT application No. PCT/US00/42411 counterpart of above–identified US application ; mailed Feb. 1, 2002.

* cited by examiner

*Primary Examiner*—Jeffery Hofsass
*Assistant Examiner*—Daniel Previl
(74) *Attorney, Agent, or Firm*—Welsh & Katz, Ltd.

(57) ABSTRACT

A modular detector includes at least one module receiving port. Members of a plurality of modules have a common form factor and are removably insertable into the port. Members of the plurality, when inserted, implement a selected communication, sensing or output function. One module can be removed and replaced with another thereby changing detector characteristics. A respective detector could have several ports to receive a plurality of insertable modules.

27 Claims, 7 Drawing Sheets

TOP ACCESS - VERTICAL ORIENTATION

SIDE ACCESS - HORIZONTAL ORIENTATION

SIDE ACCESS - VERTICAL ORIENTATION

MODULAR DETECTOR SYSTEM

This application claims the benefit of Provisional Application Ser. No. 60/172,458 filed Dec. 17, 1999.

FIELD OF THE INVENTION

The invention pertains to ambient condition detectors. More particularly, the invention pertains to such detectors which facilitate user flexibility in defining over-all function characteristics.

BACKGROUND OF THE INVENTION

Smoke detectors have become commonly used in residential applications. Many residences incorporate a plurality of such detectors either operating in a stand-alone fashion or interconnected in some way.

Known detectors are manufactured in large quantities using automated manufacturing equipment, and, as a result, have become very cost effective in inexpensive consumer products. Automated manufacturing processes provide maximum economic benefit where large numbers of identical products can be manufactured. While beneficial from a cost perspective, large volume manufacturing produces products having a common set of functional parameters with little or no opportunity to vary those parameters subsequent to production.

There are times where it might be desirable to be able to vary the parameters of a detector. For example, while fire detectors very often incorporate smoke sensors, it might be desirable to also incorporate a temperature or a humidity sensor in some installations but not all. Additionally, it might be desirable to be able to provide a voice messaging output function for some installations but not others.

There are thus continues to be a need to be able to manufacture detectors which exhibit a greater degree of functional variability than heretofore has been available in volume. Preferably, such flexibility could be provided without significantly increasing manufacturing costs or detector complexity.

SUMMARY OF THE INVENTION

A detector system includes a common mechanical/electrical, section and a plurality of electrical interchangeable modules. The modules have a common physical form factor and a common electrical interface. Different modules provide different functions implemented at least in part by respective circuitry carried therein.

The common section can be combined with a user selected set of modules prior to installation. The user can alter the module mix after installation.

In one embodiment, a single station smoke detector has the ability to receive various plug-in modules at the consumer's discretion. In one aspect, a smoke alarm has the flexibility of add-on functions such as RF (radio-frequency), remote testing and monitoring, voice alarm, I-chip for internet protocol and a modem. These functions can be selectively provided using a plurality of plug-in modules having a standardized interface and form factor. This invention provides the consumer with a myriad of different functional choices. In one embodiment, a microprocessor uses each plug-in module's function and performance to provide a customized, user alterable, detector.

The detector can incorporate fire/smoke sensors, gas, chemical, humidity, temperature sensors and other sensors. These can be permanently installed or addable using modules. Other types of interfaces or outputs can be provided using modules.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
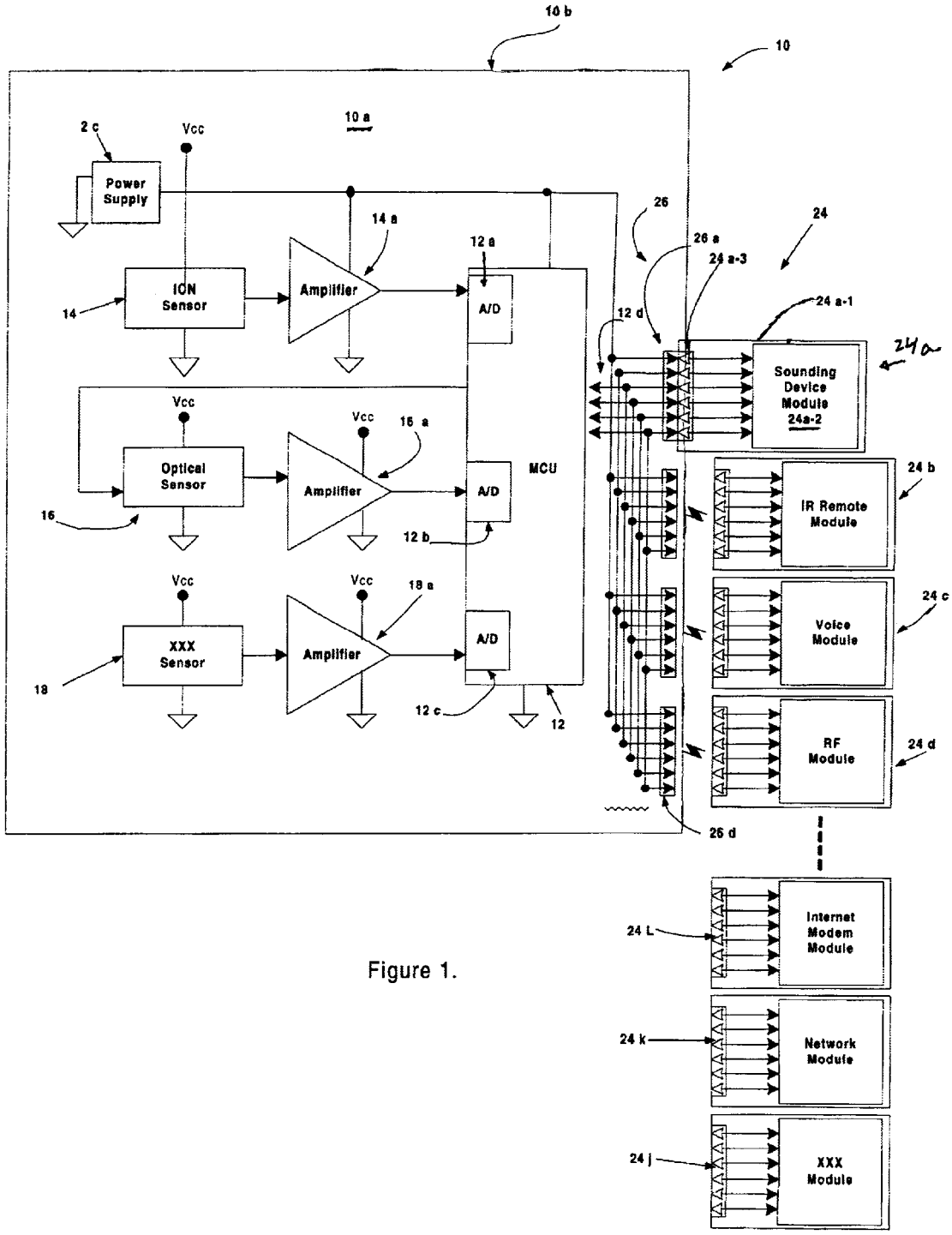
FIG. 1 is an over-all block diagram of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a modular system 10 in accordance with the present invention. System 10 incorporates a support element 10*a* which could be implemented for example as one or more printed circuit boards. Support element 10*a* as would be understood by those of skill in the art would be carried by a housing generally indicated at 10*b*.

In the exemplary embodiment of FIG. 1, control circuitry 12, implemented using a programmed processor is carried on the board or element 10*a*. The control circuitry 12 includes a plurality of analog input ports 12*a, b, c* which are coupled to internal analog/digital converters. A plurality of bidirectional digital ports 12*d* provide four or eight bit binary bidirectional communication.

System 10 can incorporate a plurality of ambient condition sensors such as smoke sensors 14, 16 illustrated as exemplary ionization-type and photoelectric-type smoke sensors. Detector 10 can also incorporate other sensors generally indicated at 18.

Outputs from the respective sensors 14–18 can be coupled through interface circuitry 14*a*, 16*a* and 18*a* to the analog inputs of control circuitry 12 as would be understood by those of skill in the art.

System 10 incorporates, for example, a plurality of modules 24 which are removably couplable via a plurality of connectors 26, carried on support element 10*a*, to control circuitry 12. It will be understood that while connectors 26 are illustrated coupled to the binary input/output ports 12*d* of control circuitry 12, that if other forms of control circuitry such as hardwired elements are used, corresponding connections would be made to connectors 26.

Each of the modules of the plurality 24, such as modules 24*a, b* . . . 1 provides circuitry for implementing a function not present in essentially permanent form in system 10. Rather, by selecting among the available modules, it is possible to customize the functional characteristics of respective ones of systems 10 to provide differing functions. For example, if the infrared remote module 24*b* is selected, it will be possible to remotely conduct tests of the specific form of the system 10 using a displaced infrared source, to silence nuisance alarms and the like. Alternately, if voice module 24*c* is selected, a speech output can be provided in addition to any alarm indicating tones which might be provided either by an audible output device permanently coupled to control circuits 12 or one carried by module 24*a*.

Each of the modules exhibits a standardized form factor, illustrated by representative housing 24*a*-1. Carried within the housing is respective circuitry such as 24*a*-2 which provides the desired functionality of the respective module. Circuitry 24*a*-2 is coupled via connector element 24*a*-3 to control circuitry 12 where the respective module is plugged into or engaged with respective connector 26, such as connector 26*a*.

Since the illustrative system 10 incorporates four system connectors 24*a, b, c, d*, four different functional modules can be selected and incorporated thereinto. It will be understood that not all four modules need be selected for every installation. More modules can be provided if desired.

The present invention provides great flexibility to a user whereby representative detector 10 can be installed at a user's premises, such as the user's house, and the selected module combination can be varied by the user both before or after installation to provide a customized detector system for that particular installation.

It will be understood that the number of connectors 26 is exemplary only and is not a limitation of the present invention. Similarly, the functionally of exemplary modules 24 is also merely exemplary and is not a limitation of the present invention.

Various configurations of housings, such as the housing 10*b* and selected modules 24 are discussed subsequently. It will be understood that various modular detector systems 10-1, -2, -3 which are discussed subsequently are merely exemplary and other variations are possible and come within the spirit and scope of the present invention.

It will also be understood by those of skill in the art that the use of standardized modules as disclosed herein makes it possible to not only obtain the benefit of economics of scale from automated manufacturing of standardized products, such as the system 10, exclusive of the modules, but also to retain the benefits of flexibility. The modules 24 provide user flexibility of a type heretofore not available in residential ambient condition detectors.

Figure 2:
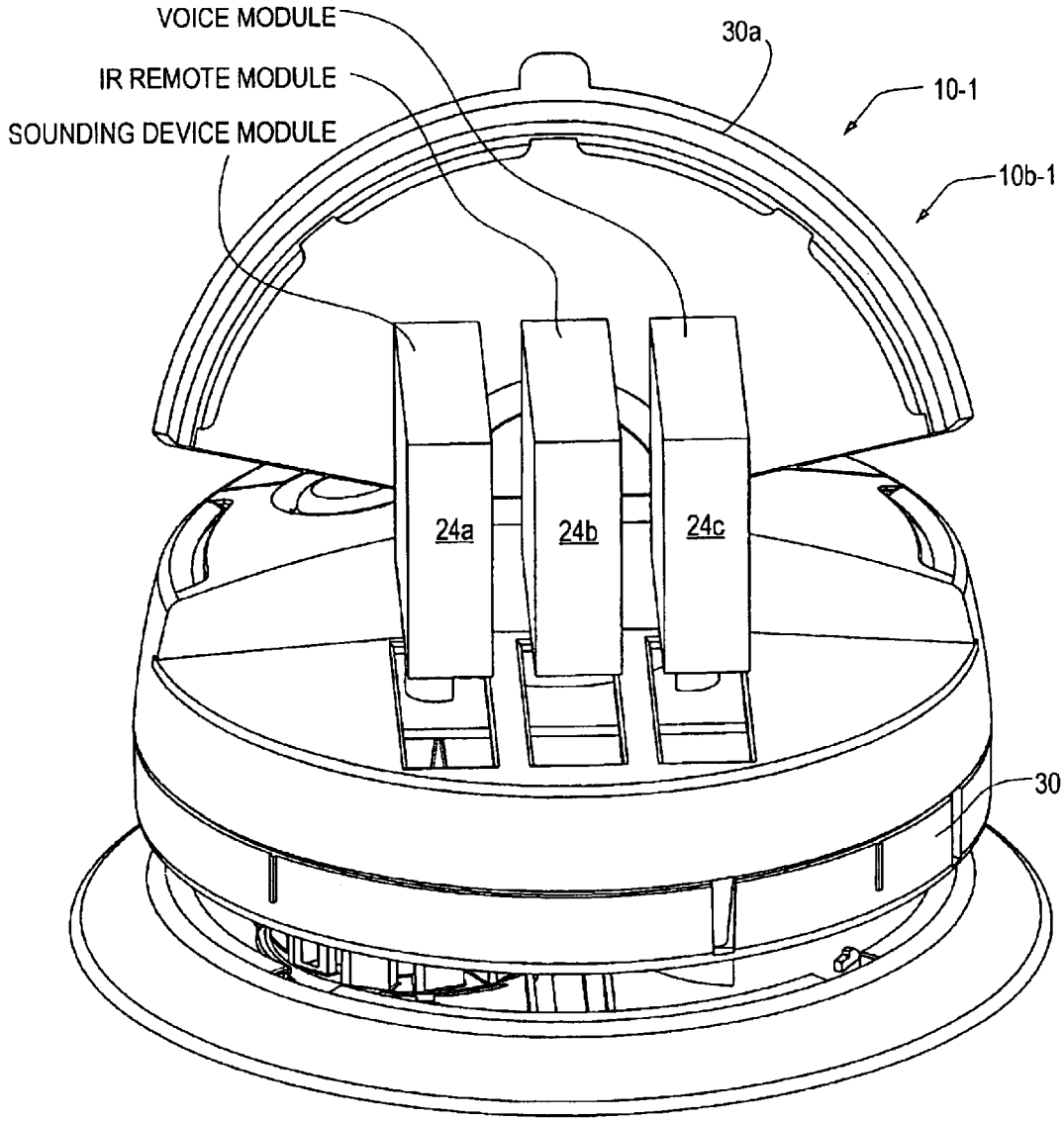
FIG. 2 is a perspective view of an embodiment of a system in accordance with the present invention.
Figure 3:
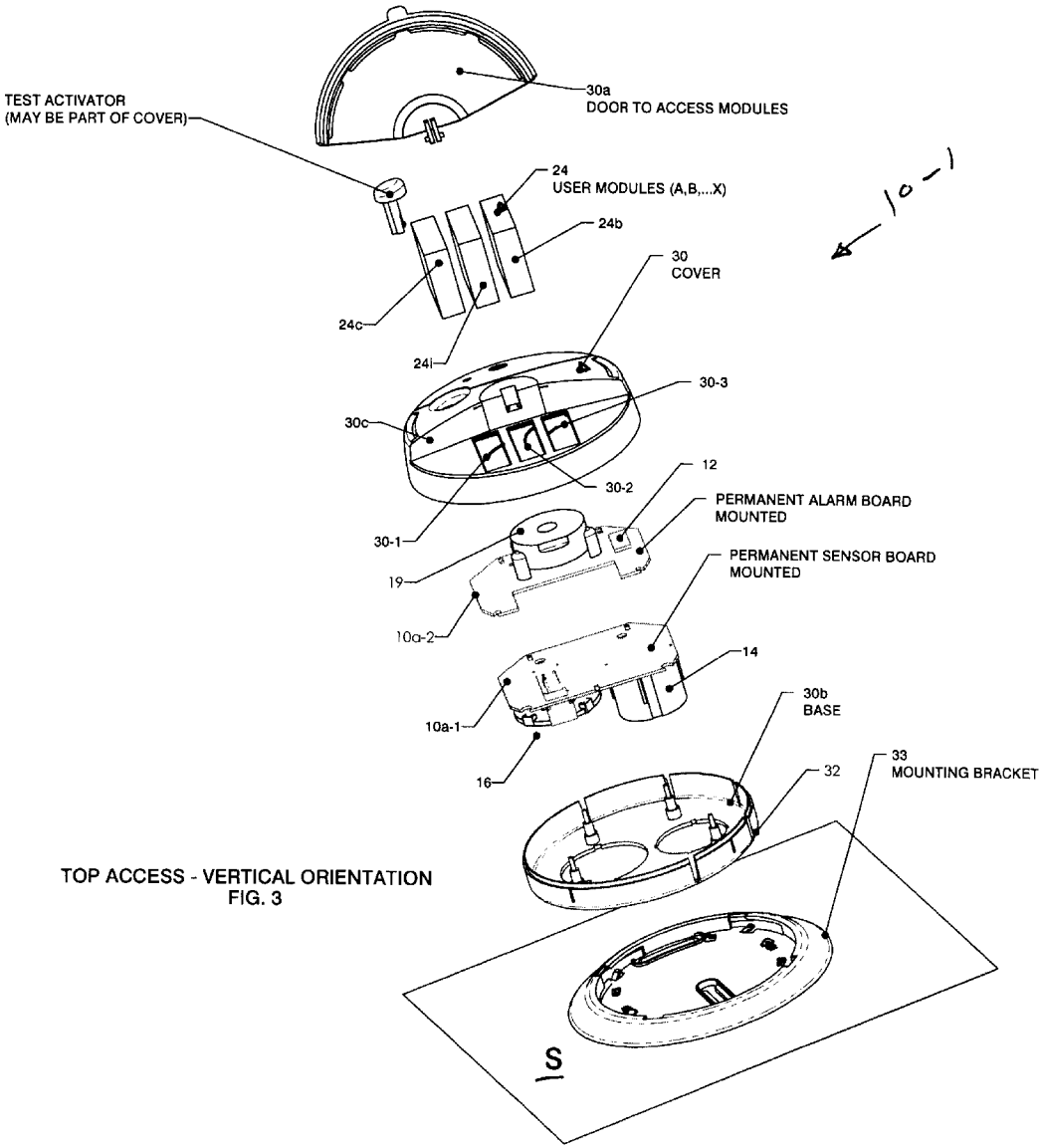
FIG. 3 is an exploded view of the system of FIG. 2.

FIGS. 2 and 3 illustrate various views of a detector system 10-1 wherein the modules can be inserted into an exposed, user-accessible, surface of the housing 10*b*-1. With respect to FIGS. 2 and 3, housing 10*b*-1 is formed with a cover 30 which has a rotatable door 30*a* attached thereto. The cover 30 is in turn attached to base 30*b* which has an exterior mounting surface 32 which is intended to be located adjacent to a mounting surface S such as a ceiling via a mounting bracket 33. When so-mounted, the pivotable door 30*a* extends away from the ceiling and is accessible to a user.

The system 10*a*-1 incorporates printed circuit boards or mounting elements 10*a*-1 and 10*a*-2 corresponding to element 10*a* of FIG. 1.

As illustrated in FIG. 3, control circuitry 12 can be carried, for example, on mounting element 10*a*-2 along with other electronic circuitry and if desired, a permanently mounted audible output device 19. The device 19 could for example be capable of generating a plurality of alarm indicating output tones as would be known to those of skill in the art.

When the cover 30*a* has been rotated to an open position, the user is provided access to a plurality of ports 30-1, -2 and -3 in surface 30*c* of cover 30. The ports 30-1, -2 and -3 provide mechanical access for selected modules from the plurality 24, such as modules 24*b, c*, and *i* to be inserted into the cover 30 and to removably engage control element 12 via connectors such as connectors 26 and 24*i*-3.

Insertion of the indicated modules into the ports 30-1, 30-2 and 30-3 provides an easy and convenient way for a user to provide selected additional functions in the respective systems 10-1 not present in the common base portion thereof. The functionality can be revised and altered during the life of the system 10*a*-1 by changing the mix of inserted modules 24.

Figure 4:
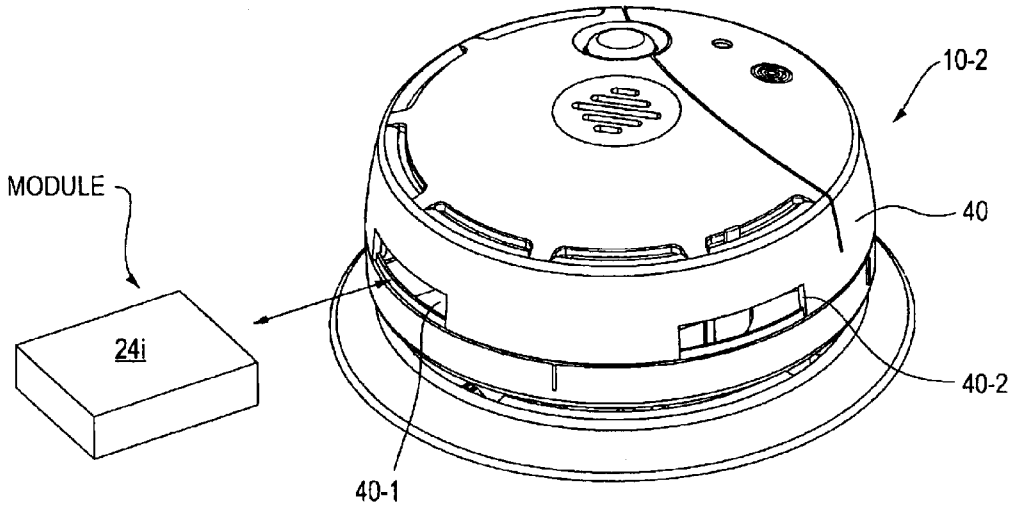
FIG. 4 is a perspective view of an alternative embodiment of the present invention.
Figure 5:
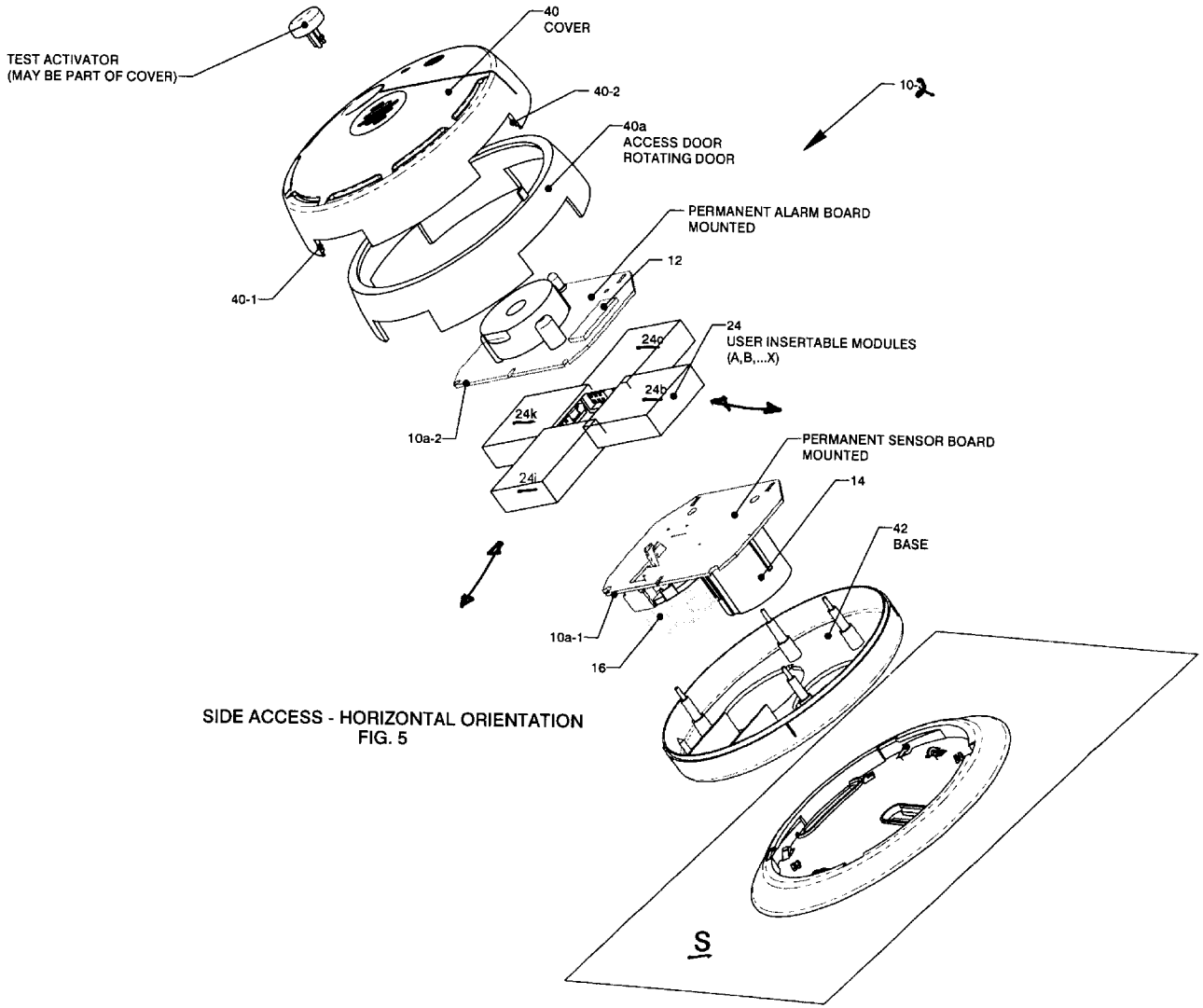
FIG. 5 is an exploded view of the embodiment of FIG. 4.

FIGS. 4 and 5 illustrate an alternate configuration, system 10-2. In system 10-2, cover 40 encloses a rotating access door 40*a*. Both cover 40 and access door 40*a* are slotted for a plurality of module receiving slots 40-1, 40-2, 40-3 and 40-4.

In the configuration of FIGS. 4 and 5, a plurality of modules, such as modules 24*b*, 24*c*, 24*i* and 24*k* extend laterally relative to a central axis of cover 40 through ports 40-1 . . . -4 in cover 40 and rotating access door 40*a*. When so inserted, the respective modules slideably engage control circuitry 12 via connectors such as connectors 24*b*-3, 24*c*-3, 24*i*-3, 24*k*-3 and connectors 26.

It will be understood that less than four modules can be used with the system 10-3 without departing from the spirit and scope of the present invention. In such an instance, detector system 10-3 would simply provide fewer selected functions than in an instance where a larger number of modules was being used.

Figure 6:
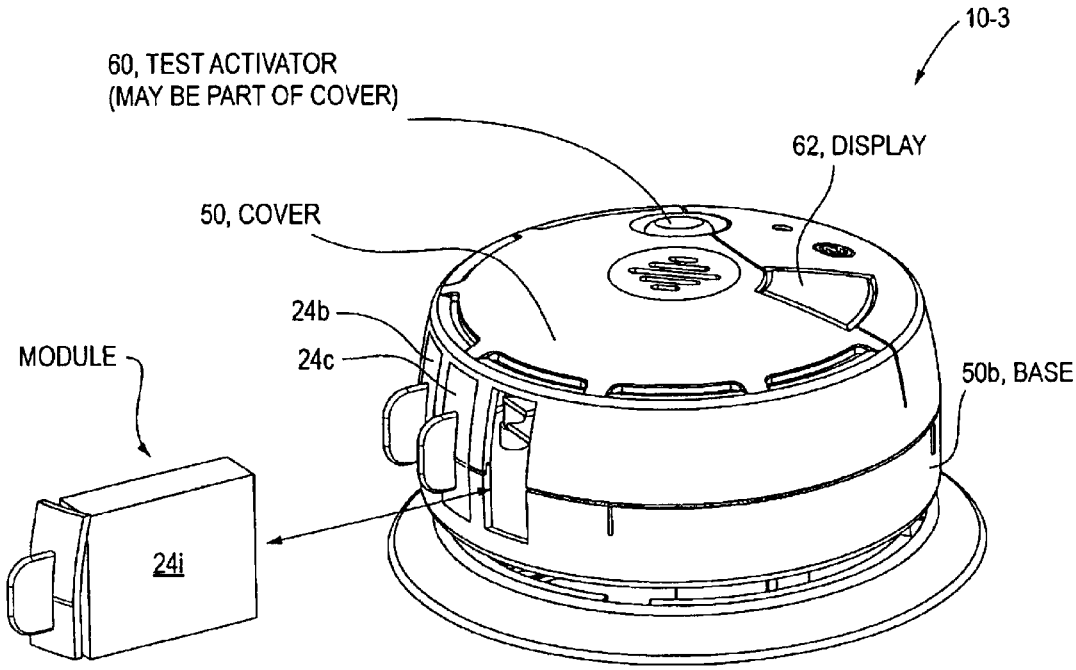
FIG. 6 is a perspective view of yet another embodiment of the present invention.
Figure 7:
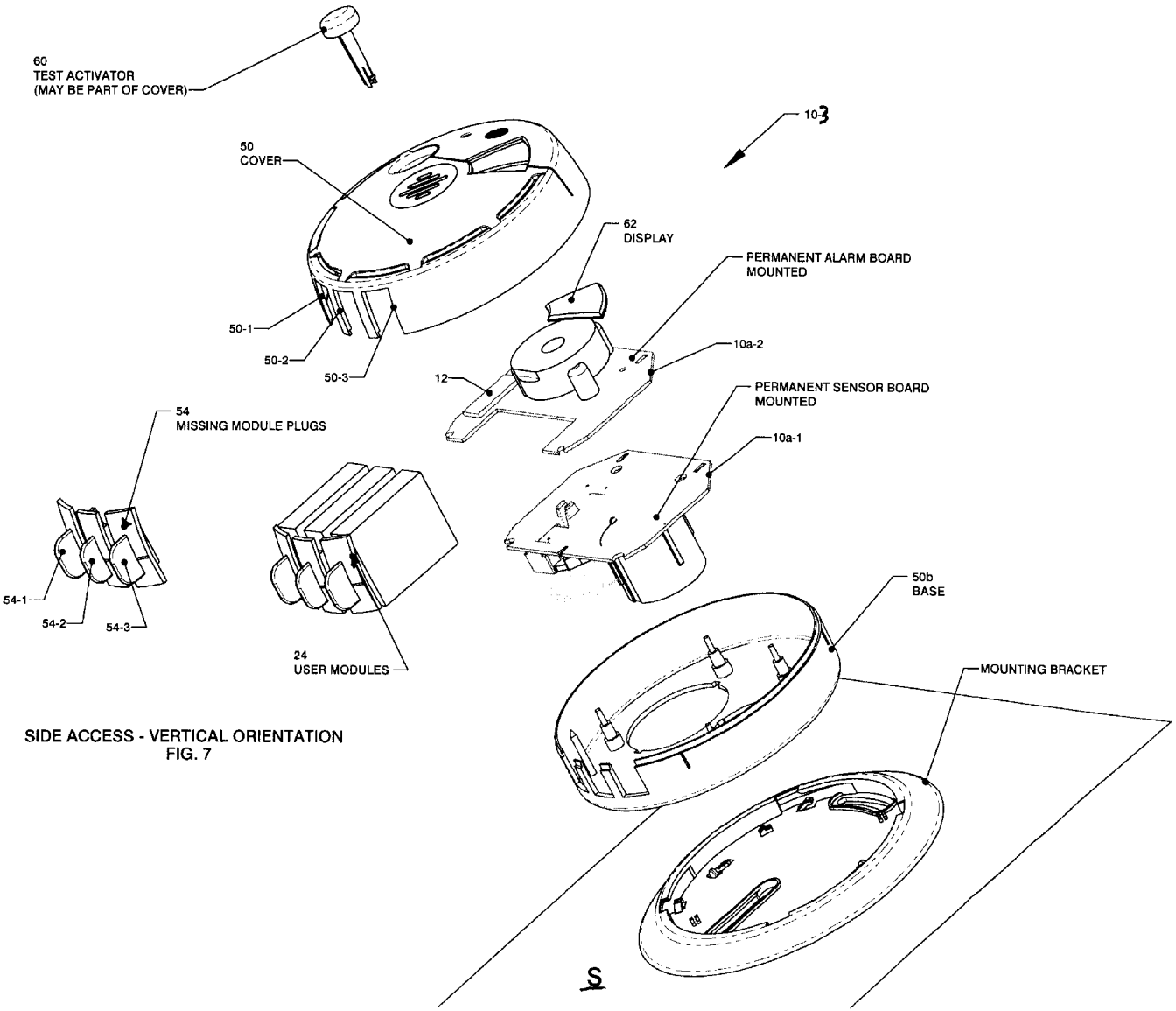
FIG. 7 is an exploded view of the embodiment of FIG. 6.

FIGS. 6 and 7 illustrate yet another configuration in a system 10-3. In the system 10-3, ports 50-1 . . . 50-n are provided in cover and base sections 50, 50*b*. The ports 50-1 . . . 50*n* provide user access for a selected number of modules from the plurality 24 which can be removably inserted through the respective port to engage control circuitry 12. Additionally, in the event that fewer modules are selected than there are available ports, a plurality of missing module plugs 54 can be used as inserts to fill in unused ports 50-i for aesthetic purposes and to keep dust and other debris from the interior of the housing 50.

It will be understood that a variety of additional features can be incorporated into the respective detector systems without departing from the spirit and scope of the present invention. Representative additional types of features include test activation switches or buttons such as button 60, or, display 62 which can be incorporated into respective housings, such as the housing 50, to provide alpha numeric readouts such as concentration status and the like. It will be understood that such features while convenient and desirable at times are selectable and provideable without departing from the spirit and scope of the present invention. They can also be provided via one or more plug-in modules.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector comprising:

a housing which defines an internal region and which has a mounting end;

at least one smoke sensor permanently installed in the housing; and a plurality of plug-in modules wherein the modules each exhibit a common, predetermined, shape and wherein each provides a different function when plugged in to the housing and where the smoke sensor, and any plugged-in module are spaced axially within the housing relative to one another along a line generally perpendicular to the mounting end of the housing.

2. A detector as in claim 1 wherein the housing includes a two sided mounting member in the region whereby plugged-in modules are located on one side of the member and the smoke sensor is attached to the other side of the member.

3. A detector as in claim 1 wherein the respective modules implement a function selected from a class which includes ambient condition sensing functions, monitoring functions, interface functions, and communications functions.

4. A detector as in claim 1 wherein the housing comprises a base that includes the mounting end and a cover which define the internal region with the base positionable adjacent to an exterior mounting surface with the smoke sensor oriented to extend toward the base.

5. A detector as in claim 4 where a plurality of module receiving slots is formed in the cover, members of the plurality of slots are displaced a greater distance from the base than is the smoke sensor.

6. A detector comprising:

a housing with a mounting surface, the housing defines an internal region, and, which has openings for ingress and egress of ambient air;

at least one fire sensor permanently carried in the housing in the internal region and not intended to be removed therefrom, the sensor is exposed to a flow of ambient air; a plurality of module receiving openings in the housing with the module receiving openings displaced from the mounting surface a greater distance than the fire sensor is displaced from the mounting surface relative to a common centerline.

7. A detector as in claim 6 which includes a mounting member attached to the housing in the internal region with the fire sensor permanently installed on one side of the member, and with the module receiving openings on the other side thereof.

8. A detector as in claim 6 with the module receiving openings defining respective planes disposed one of, generally parallel to the centerline or generally perpendicular to the centerline.

9. A detector as in claim 8 wherein modules insertable into the openings are selected from a class which includes at least an audible output module, a display module, a test module, and a wireless module.

10. A detector comprising:

a housing with a base, the housing defining an internal region and having openings for ingress and egress of ambient air;

a mounting member attached to the housing in the region;

a first, fire sensor permanently and non-removably attached to the mounting member, the sensor extending toward the base responsive to ambient air in the housing;

the housing defining a plurality of slots for receipt of modules having a common form factor, the slots are displaced further from the base than is the fire sensor.

11. A detector as in claim 10 with the mounting member comprising a two-sided, planar structure with the fire sensor attached to one side thereof and with the slots adjacent to the other side.

12. A detector as in claim 10 which includes a second, different, fire sensor permanently and non-removably attached to the mounting member, the second sensor also extending toward the base.

13. A detector as in claim 12 with the mounting member comprising a two-sided, planar structure with the two fire sensors attached to one side thereof and with the slots adjacent to the other side.

14. A detector as in claim 10 which includes a plurality of modules, the modules are receivable by the slots to provide an additional function not permanently included in the housing, the modules are selected from a class which includes at least an audible output module, a display module, a test module, and a communications module.

15. A detector as in claim 14 with a plurality of module receiving contacts, the contacts are displaced from the fire sensor and away from the base with the mounting member between the plurality of contacts and the fire sensor.

16. A detector as in claim 15 which includes a second, different, fire sensor carried in the housing, adjacent to the first fire sensor.

17. A detector comprising:

a housing which defines an internal region and which has a mounting end, the housing defines a plurality of module receiving openings;

at least one smoke sensor permanently installed in the housing; and a plurality of plug-in modules wherein the modules each exhibit a common, predetermined, shape and wherein each provides a different function when coupled to a respective opening of the housing and where the smoke sensor, and any coupled module are spaced axially within the housing relative to one another along a line generally perpendicular to the mounting end of the housing.

18. A detector as in claim 17 wherein the housing includes a two sided mounting member in the region whereby coupled modules are located on one side of the member and the smoke sensor is attached to the other side of the member.

19. A detector as in claim 17 wherein the respective modules are releasibly coupled to the housing and implement a function selected from a class which includes ambient condition sensing functions, monitoring functions, interface functions, and communications functions.

20. A detector as in claim 17 wherein the housing comprises a base that includes the mounting end and a cover which define the internal region with the base positionable adjacent to an exterior mounting surface with the smoke sensor oriented to extend toward the base.

21. A detector as in claim 17 where the plurality of openings is displaced a greater distance from the base than is the smoke sensor.

22. A detector comprising:

a housing with a base, the housing defining an internal region and having openings for ingress and egress of ambient air;

a mounting member attached to the housing in the region;

a first, fire sensor permanently and non-removably attached to the mounting member, the sensor extending toward the base responsive to ambient air in the housing;

the housing defining a plurality of substantially identical slots for releasable receipt of a plurality of different modules having a common form factor, the slots are displaced further from the base than is the fire sensor.

23. A detector as in claim 22 with the mounting member comprising a two-sided, planar structure with the fire sensor attached to one side thereof and with the slots adjacent to the other side.

24. A detector as in claim 22 which includes a second, different, fire sensor permanently and non-removably attached to the mounting member, the second sensor also extending toward the base.

25. A detector as in claim 22 the modules are releasibly receivable by the slots to provide an additional function not permanently included in the housing, the modules are selected from a class which includes at least an audible output module, a display module, a test module, and a communications module, with characteristics of the detector alterable by module selection.

26. A detector as in claim 25 with a plurality of module receiving contacts, the contacts are displaced from the fire sensor and away from the base with the mounting member between the plurality of contacts and the fire sensor.

27. A detector as in claim 25 which includes a second, different, fire sensor carried in the housing, adjacent to the first fire sensor.

* * * * *